US011578855B2

(12) United States Patent
Liu et al.

(10) Patent No.: US 11,578,855 B2
(45) Date of Patent: Feb. 14, 2023

(54) NIGHT LAMP AND METHOD FOR CONTROLLING THE SAME

(71) Applicant: Shenzhen Easzzz Technology Co. Ltd, Shenzhen (CN)

(72) Inventors: Binwen Liu, Shenzhen (CN); Gang Peng, Shenzhen (CN); Lishun Peng, Shenzhen (CN); Dongping Zheng, Shenzhen (CN); Jianhua Chen, Shenzhen (CN); Peilong Pang, Shenzhen (CN)

(73) Assignee: SHENZHEN EASZZZ TECHNOLOGY CO., LTD.

( * ) Notice: Subject to any disclaimer, the term of this patent is extended or adjusted under 35 U.S.C. 154(b) by 0 days.

(21) Appl. No.: 16/821,338

(22) Filed: Mar. 17, 2020

(65) Prior Publication Data

US 2021/0071846 A1 Mar. 11, 2021

(30) Foreign Application Priority Data

Sep. 6, 2019 (CN) ..... 201921481065.7

(51) Int. Cl.

| | |
|---|---|
| ***F21V 9/40*** | (2018.01) |
| ***F21V 9/08*** | (2018.01) |
| ***F21V 3/02*** | (2006.01) |
| ***F21Y 101/00*** | (2016.01) |
| ***F21W 131/30*** | (2006.01) |

(52) U.S. Cl.

CPC ..... *F21V 9/40* (2018.02); *F21V 3/02* (2013.01); *F21V 9/083* (2013.01); *F21W 2131/30* (2013.01); *F21Y 2101/00* (2013.01)

(58) Field of Classification Search

CPC .. F21V 9/40; F21V 3/02; F21V 9/083; F21W 2131/30; F21Y 2101/00

See application file for complete search history.

(56) References Cited

U.S. PATENT DOCUMENTS

| | | | | |
|---|---|---|---|---|
| 6,155,700 | A * | 12/2000 | Hsu | A63H 17/28 362/196 |
| 8,408,736 | B2 * | 4/2013 | Chien | F21V 14/02 362/235 |
| 8,926,140 | B2 * | 1/2015 | Wheelock | F21V 19/001 362/294 |
| 9,062,858 | B2 * | 6/2015 | Yoo | F21V 5/002 |
| 9,657,916 | B2 * | 5/2017 | Hussey | F21V 3/02 |
| 9,714,904 | B2 * | 7/2017 | Chang | G01N 21/8806 |
| 9,890,938 | B2 * | 2/2018 | Zhang | F21V 21/30 |
| 10,509,304 | B2 * | 12/2019 | Chien | G03B 29/00 |
| 2013/0069089 | A1 * | 3/2013 | Hussell | F21K 9/61 257/88 |
| 2014/0001945 | A1 * | 1/2014 | Yamamoto | F21V 7/0091 313/111 |
| 2014/0333199 | A1 * | 11/2014 | Wang | F21K 9/90 313/512 |

(Continued)

FOREIGN PATENT DOCUMENTS

CN 204153661 U * 2/2015

*Primary Examiner* — Tsion Tumebo

(74) *Attorney, Agent, or Firm* — Kim IP Law Group LLC

(57) ABSTRACT

Disclosed herewith is a night lamp having a flexible upper cover, a base ring, a bottom cover, and a light-emitting assembly. The base ring is configured to be in engagement with the upper cover and the bottom cover at the same time, forming a complete sphere.

19 Claims, 5 Drawing Sheets

(56) References Cited

U.S. PATENT DOCUMENTS

2015/0369430 A1* 12/2015 Vamberi ..... F21V 5/08
362/235
2017/0038031 A1* 2/2017 Chien ..... F21V 5/00

* cited by examiner

NIGHT LAMP AND METHOD FOR CONTROLLING THE SAME

TECHNICAL FIELD

The invention relates to a night lighting device, in particular a night lamp. The invention further relates to a method for controlling the night lamp.

TECHNICAL BACKGROUND

A night lamp is a device used to provide illumination at night. It is usually used in corridors, aisles, and bedrooms, and fixed to a wall. In recent years, use of the night lamp in bedrooms has become more and more popular. It is generally installed at the bedside to provide lighting for those getting up at night.

A traditional night lamp has a mechanical switch that requires user to turn on or off manually. However, since the user on the bed needs to reach out to operate the switch, this obviously causes inconvenience. There are also a large number of night lamps using sound-activated switches in the market. In this way, the user can turn on or off the night lamp by making a sound, so that getting up is unnecessary, which is convenient to a certain extent. However, due to the presence of environmental noise, such a sound-activated night lamp will easily be accidentally triggered, causing turn on or off undesirably.

In addition, current night lamp contains many components, so that the assembly process thereof is complicated. Moreover, the appearance of the night lamp is unpleasant due to use of mounting screws. In addition, for the current night lamp, the control experience of the user is very poor, and the user cannot easily control and adjust the light.

SUMMARY OF THE INVENTION

The present invention aims to provide an improved night lamp, which can be readily turned on or off by a user, and light emitted by the night lamp can be adjustable. In addition the night lamp has a compact structure and attractive appearance. The present invention further provides a method for controlling the night lamp.

According to a first aspect of the present invention, a night lamp is proposed, comprising: a flexible partially spherical upper cover, which has a wall defining a first cavity and having a flat bottom portion; a base ring, including a ring body, a lamp cap arranged at a first side of the ring body, and a hollow cylinder arranged at a second side thereof; a partially spherical bottom cover, which defines a second cavity and has a mating surface; and a light-emitting assembly. The base ring is configured to be in engagement with the upper cover and the bottom cover at the same time, so that the bottom portion of the upper cover is abutted against the mating surface of the cover, and the upper cover and the bottom cover together form a complete sphere. The ring body and the lamp cap of the base ring are located in the first cavity while the hollow cylinder is located in the second cavity, and the light-emitting assembly is located in the hollow cylinder.

In an embodiment, the bottom portion extends radially inward, thereby defining an annular locking groove in the first cavity, the ring body being in engagement with the locking groove.

In an embodiment, an annular groove is formed in the bottom portion to divide the bottom portion to an outer part and an inner part, the latter being provided with a plurality of projections spaced apart from each other.

In an embodiment, each projection extends beyond the bottom portion, and is provided with a circular bulge extending radially inward at a root part thereof.

In an embodiment, a plurality of tongues protruding radially outward is provided on an outer periphery of the cylinder of the base ring, forming an annular recess between the tongues and the base ring. A first tooth is provided between two adjacent tongues, and each tongue is provided with a notch for allowing a corresponding projection to pass therethrough.

In an embodiment, the mating surface of the bottom cover has an annular vertical wall extending outward, which is configured to extend into the annular groove for engagement therewith.

In an embodiment, a plurality of connecting members is provided in the second cavity of the bottom cover, each including an arc-shaped plate and a plurality of ribs connecting the arc-shaped plate with the vertical wall, so that the ribs, the arc-shaped plate and the vertical wall together define at least one recess for receiving a corresponding projection. A second tooth is arranged on an inner side of each arc-shaped plate for engagement with a corresponding first tooth.

In an embodiment, the light-emitting assembly comprises a control unit, a lamp bead mounted on the control unit, and a battery. Several support posts are provided in the second cavity of the bottom cover, the control unit being mounted on the support posts and the battery being located in a space defined by the support posts.

In an embodiment, the control unit includes a state sensor, which is configured to activate the lamp bead not to emit light when the bottom cover faces downward but to emit light when the bottom cover faces upward.

In an embodiment, the state sensor comprises two flip switches, which are respectively mounted on two opposite surfaces of the control unit. A first flip switch is configured to activate the lamp bead not to emit light when the bottom cover faces downward, while a second flip switch is configured to activate the lamp bead to emit light when the bottom cover faces upward.

In an embodiment, the state sensor is a gyroscope.

In an embodiment, the lamp cap is spaced from an inner surface of the upper cover, and the control unit includes a conductive spring, which extends through the lamp cap to enter the first cavity. The upper cover can be pressed to contact the conductive spring, so that the control unit is in a power-on state.

In an embodiment, the lamp cap contains light-homogenizing powders.

In an embodiment, the bottom cover has a central hole, in which a removable plug is arranged.

According to a first aspect of the present invention, a method for controlling the above night lamp is proposed, comprising steps of: pressing the upper cover to be contact with the conductive spring, so that the control unit is in a power-on state; placing the night lamp in a state in which the bottom cover faces downward, whereby the lamp bead does not emit light; and placing the night lamp in a state in which the bottom cover faces upward, whereby the lamp bead emits light.

In an embodiment, the method further comprises tapping the night lamp three times consecutively to activate the control unit in a power-off state.

In an embodiment, the method further comprises tapping the night lamp twice to enable the lamp bead to emit light from bright to dark for a period of time, until it goes out.

In an embodiment, the method further comprises pressing the upper cover to be in contact with the conductive spring for a period of time, so that the light emitted by the lamp bead has a brightness that gradually changes from dark to bright, and a color temperature that gradually changes from warm tone to cold tone during this period of time.

BRIEF DESCRIPTION OF THE DRAWINGS

In the following the present invention will be described by way of non-limiting embodiments with reference to the following drawings, in which.

In all the drawings, the same reference sign indicates the same component, and the drawings are not drawn to scale.

DETAILED DESCRIPTION OF EMBODIMENTS

Figure 1:
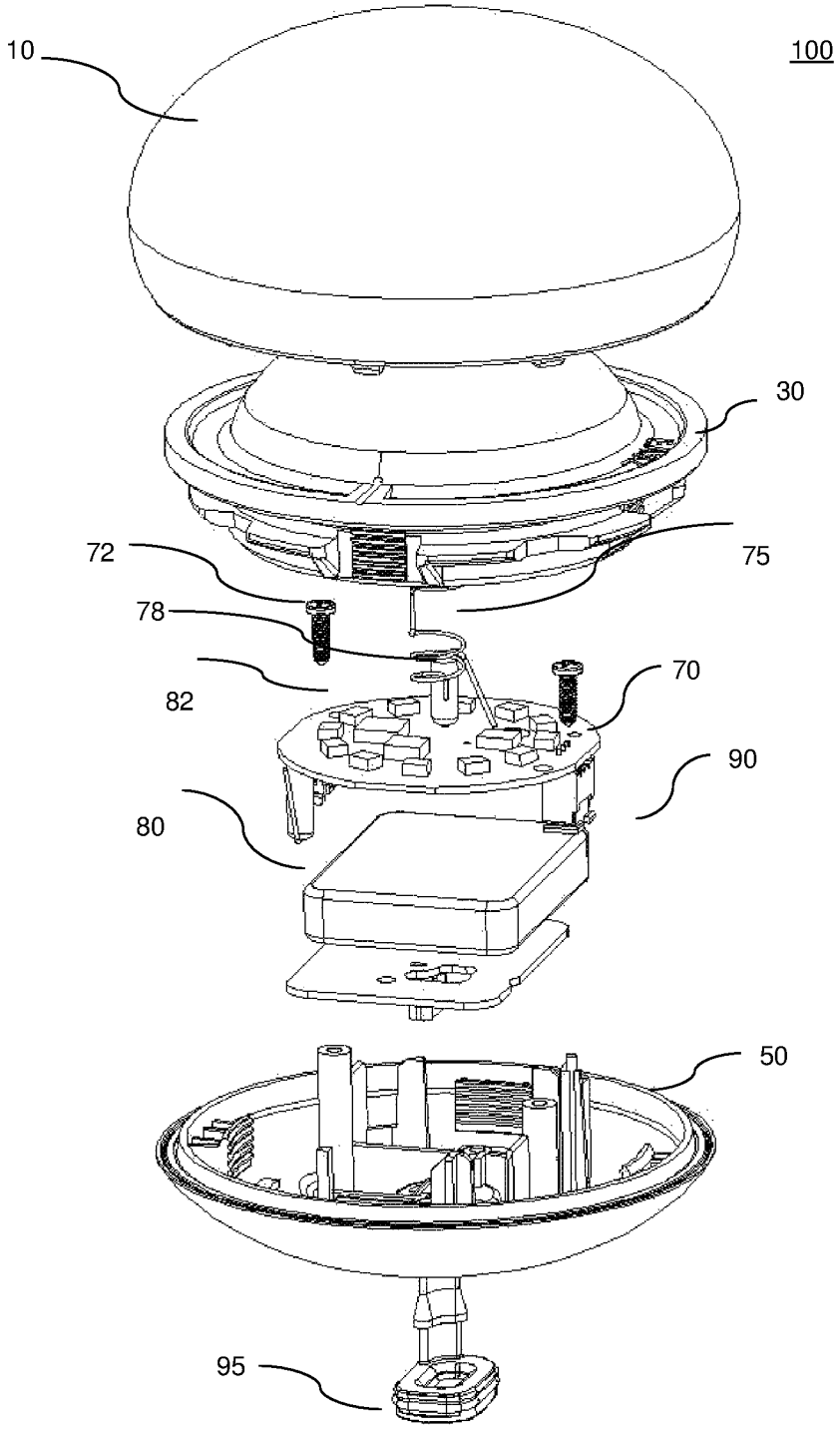
FIG. 1 shows an exploded perspective view of a night lamp according to the present invention.

FIG. 1 shows an exploded view of a night lamp 100 according to the present invention. As shown in FIG. 1, the night lamp 100 according to the present invention mainly includes an upper cover 10, a base ring 30, a bottom cover 50 and a light-emitting assembly 90. The light-emitting assembly 90 mainly includes a control unit 70, a lamp bead 78, and a battery 80, which are electrically connected to each other.

Figure 2:
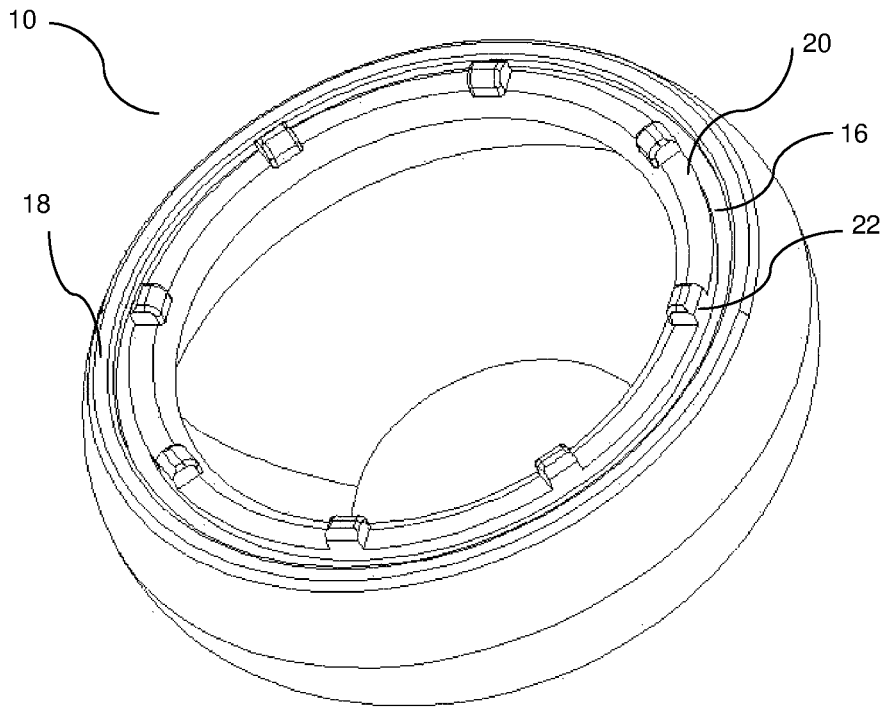
FIG. 2 shows a perspective view of an upper cover of the night lamp according to the present invention, viewed from the bottom.
Figure 3:
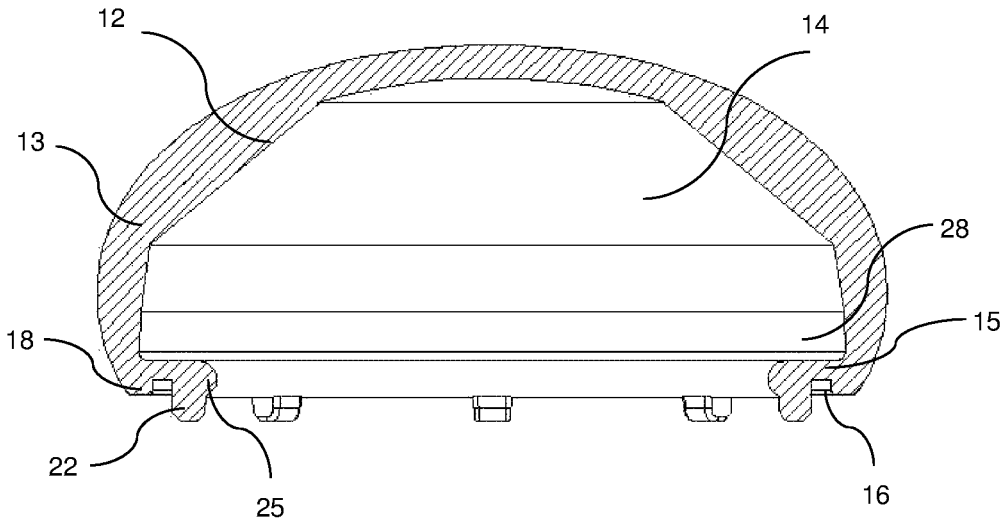
FIG. 3 shows a cross-sectional view of the upper cover of FIG. 2.

FIGS. 2 and 3 respectively show a perspective view and a cross-sectional view of the upper cover 10 of the night lamp 100 according to the present invention. As shown in FIG. 2, the upper cover 10 is made of a flexible silicone material, and has a shape of a substantially partial sphere, such as a partial ellipsoid. An inner surface 12 of the upper cover 10 defines a first cavity 14. A wall 13 of the upper cover 10 extends radially inward at a bottom portion 15 thereof, so that an annular locking groove 28 is formed in the first cavity 14 of the upper cover 10. The bottom portion 15 has a flat surface for cooperating with a mating surface 64 of the bottom cover, which will be described later. An annular groove 16 extending along a circumferential direction is formed in the flat surface, and divides the bottom portion 15 of the upper cover 10 into an outer part 18 and an inner part 20. A plurality of projections 22 is provided on the inner part 20, preferably in an evenly spaced manner along the circumferential direction. Although eight projections 22 are shown in FIG. 2, it is easy to understand that the number of the projections 22 can be arbitrarily selected according to actual needs. As shown in FIG. 3, each projection 22 has a circular bulge 25 extending radially inward at its root, which will be described below.

Figure 4:
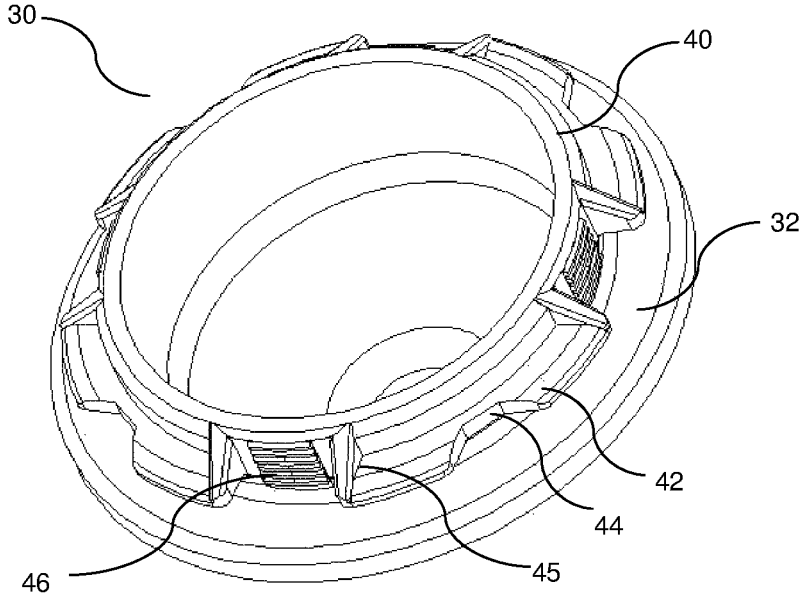
FIG. 4 shows a perspective view of a base ring of the night lamp according to the present invention.
Figure 5:
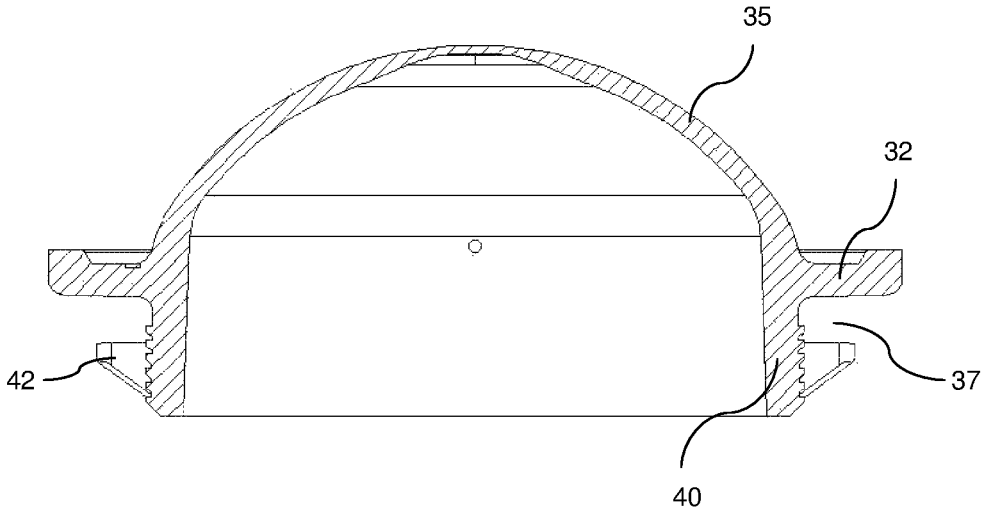
FIG. 5 shows a cross-sectional view of the base ring of FIG. 4.

FIGS. 4 and 5 respectively show a perspective view and a cross-sectional view of the base ring 30 of the night lamp 100 according to the present invention. As shown FIG. 4, the base ring 30 includes a ring body 32, and a hollow cylinder 40 extending from the ring body 32 along an axial direction. As shown in FIG. 5, a dome-shaped lamp cap 35 is provided on the ring body 32 in a direction opposite to the cylinder 40. The lamp cap 35 contains light-homogenizing powders, for homogenizing the light emitted by a lamp bead 78 (as described below), thereby obtaining soft light. The dome-shaped lamp cap 35 is sized to be accommodated in the first cavity 14 of the upper cover 10 and spaced from the inner surface 12 of the upper cover 10 by a certain distance (see FIG. 8). The lamp cap 35 is preferably integrally formed with the ring body 32, for example, by ultrasonic hot-melt treatment.

A plurality of tongues 42 protruding radially outward is provided on an outer periphery of the cylinder 40 of the base ring 30. In FIG. 4, four tongues 42 uniformly arranged in the circumferential direction are shown. However, it is easy to understand that the number of the tongues 42 can be arbitrarily selected as required. The tongues 42 are disposed in a distance from the ring body 32, so that an annular recess 37 is formed between the tongues 42 and the ring body 32. Each of the tongues 42 is provided with at least one notch 44 in a middle thereof, so that each projection 22 is allowed to pass through a corresponding notch 44 when e base ring 30 and the upper cover 10 are assembled together, for fitting into a corresponding recess 65 in the bottom cover 50. In addition, each tongue 42 is provided with ribs 45 at both sides thereof for improving strength. Between two adjacent tabs 42, a first tooth 46 is provided on the outer surface of the cylinder 40 of the base ring 30, the function of which is described below.

Figure 6:
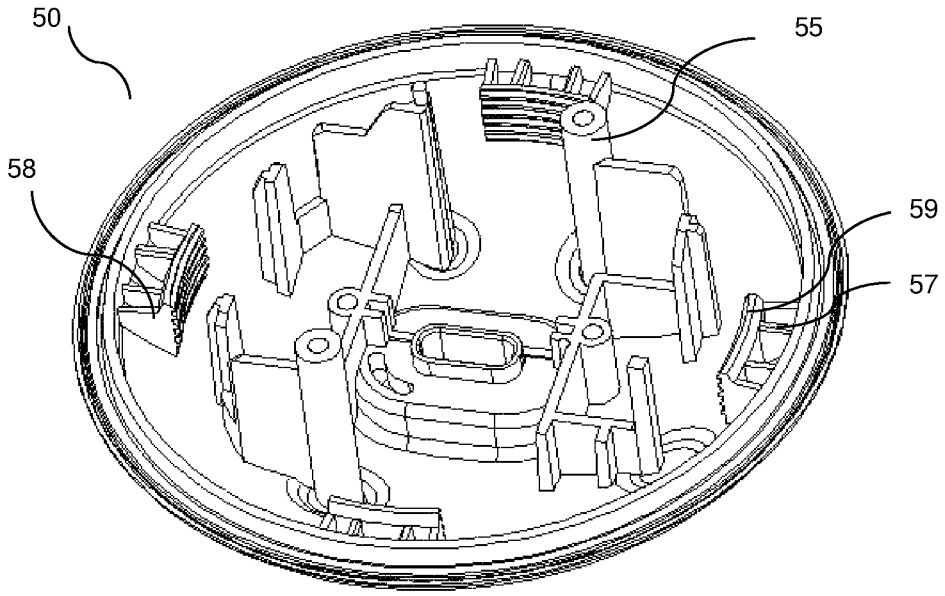
FIG. 6 shows a perspective view of a bottom cover of the night lamp according to the present invention.
Figure 7:
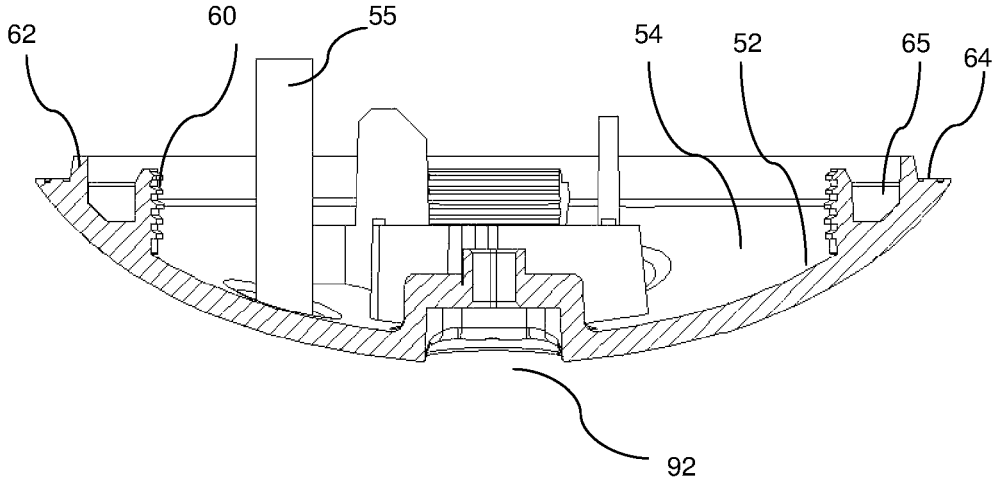
FIG. 7 shows a cross-sectional view of the bottom cover of FIG. 6.
Figure 8:
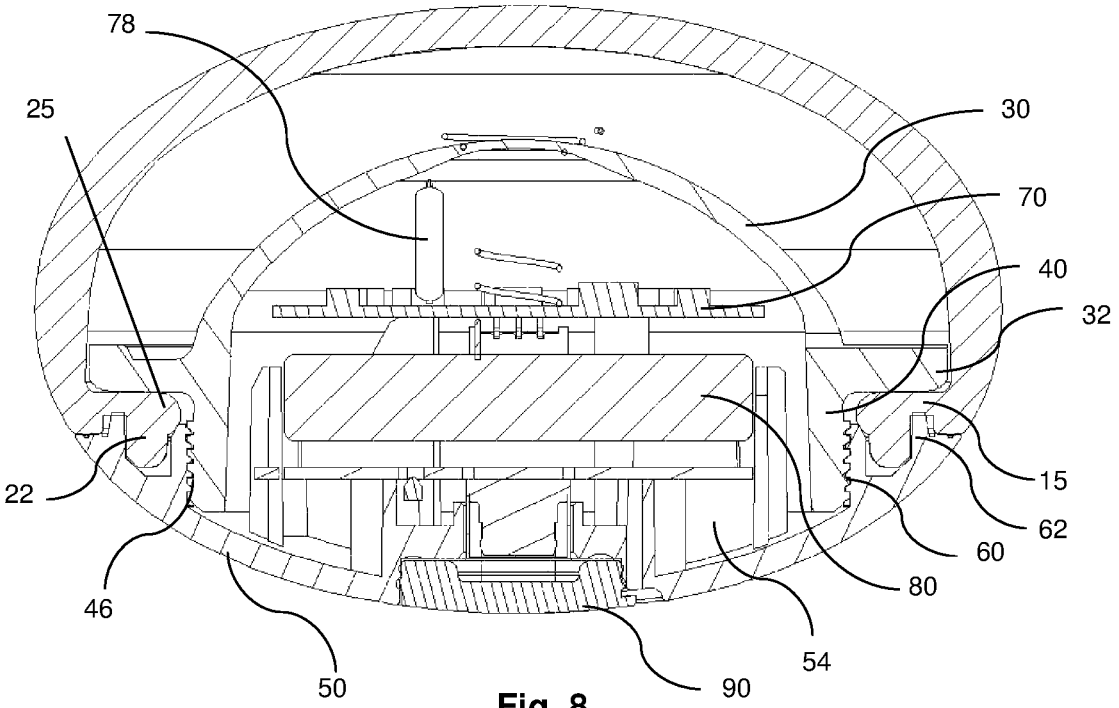
FIG. 8 shows a cross-sectional view of the night lamp according to the present invention in an assembled state.

FIGS. 6 and 7 respectively show a perspective view and a cross-sectional view of the bottom cover 50 of the night lamp 100 according to the present invention. The bottom cover 50 is made of hard plastic, such as ABS. The bottom cover 50 also has a shape of a substantially partial sphere, such as a partial ellipsoid, and when assembled with the base ring 30 and the upper cover 10, the mating surface 64 of the bottom cover 50 is abutted against the bottom portion 15 of the upper cover 10, thereby forming a complete ellipsoid to provide an attractive appearance. In this case, the base ring 30 is completely hidden inside the upper cover 10 and the bottom cover 50, as shown in FIGS. 8 and 9.

An inner surface 52 of the bottom cover 50 defines a second cavity 54, in which a plurality of supporting posts 55 is arranged. The control unit 70 of the light-emitting assembly 90 is supported on upper ends of the support posts 55. In the illustrated embodiment, the control unit is configured as a PCB. Each support post 55 is preferably hollow and internally threaded. In this way, the control unit 70 can be fixed on the support posts 55 by screws 72, as shown in FIG. 9. A lamp bead 78, preferably a low lumen lamp bead, is mounted on the control unit 70 for emitting light.

Figure 9:
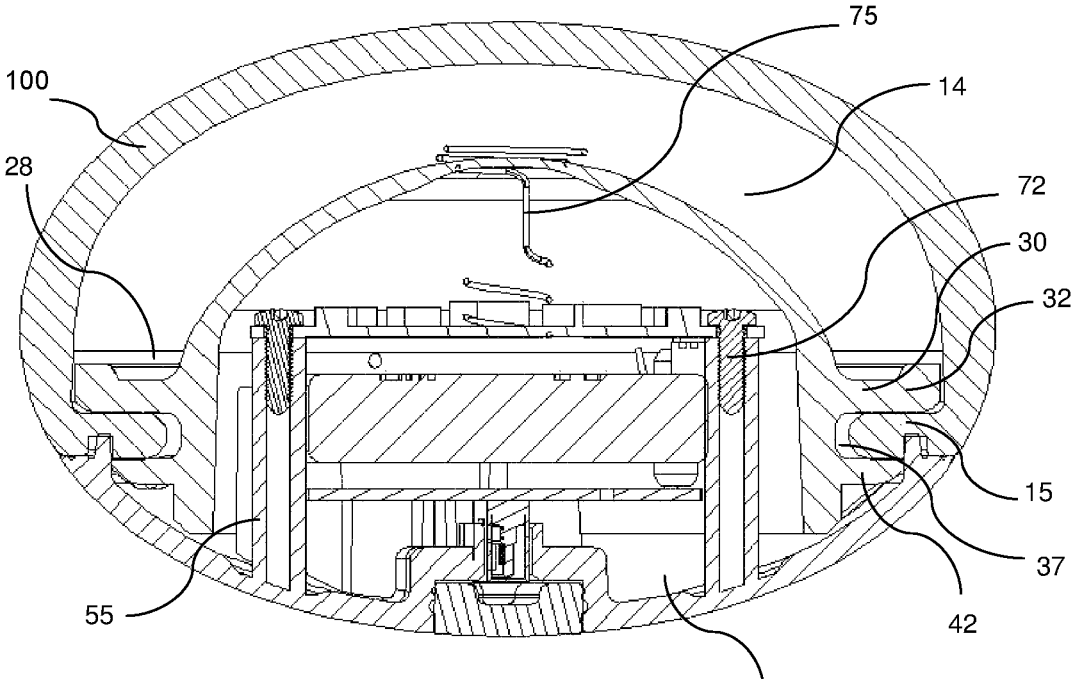
FIG. 9 shows another cross-sectional view of the night lamp according to the present invention in the assembled state.

The battery 80 of the light-emitting assembly 90 is disposed in a space defined by the support posts 55, for supplying power to the control unit 70 (FIG. 9). In this way, since the battery 80 is completely accommodated in the space created by the support posts 55, the space in the second cavity 54 of the bottom cover 50 can be fully utilized, and thus the entire structure of the lamp is very compact. In one embodiment the battery 80 is preferably a polymer battery, which has a small size of high safety. In an embodiment not shown, a charging interface is further provided in the second cavity 54 of the bottom cover 50 for charging the battery 80.

The control unit 70 is used to control the night lamp 100, which will be described in detail below. As shown in FIGS. 1, 8 and 9, a conductive spring 75 is provided on the control unit 70, and has an upper end which passes through the lamp cap 35 to enter the first cavity 14 of the upper cover 10. When the flexible upper cover 10 is pressed, the upper cover 10 can be brought into contact with the conductive spring 75.

As shown in FIG. 7, the mating surface 64 of the bottom over 50 is formed as a flat surface, and an annular vertical wall 62 extends axially from the mating surface 64. A plurality of connecting members 58 is also provided in the second cavity 54 of the bottom cover 50. These connecting pieces 58 are uniformly arranged in the circumferential direction, and the number thereof is the same as that of the first tooth 46 on the outer surface of the cylinder 40 of the base ring 30. Each connecting member 58 includes an arc-shaped plate 59 on the inner side, and a plurality of ribs 57 connecting the arc-shaped plate 59 with the vertical wall 62 of the bottom cover 50. With this structure, multiple recesses 65 are defined by the arc-shaped plate 59, the vertical wall 62 and the ribs 57, for receiving the projections 22 of the upper cover 10 respectively. A second tooth 60 is further provided on the inner face of each arc-shaped plate 59.

As shown in FIG. 7, the bottom of the bottom cover 50 is provided with an opening 92, in which a plug 95 is disposed (see FIG. 1). By removing the plug 95, the charging interface can be exposed and then used to charge the battery 80. It is easily understood that the plug 95 may be made of any suitable material, such as silicone, and its shape is adapted to the outer surface of the bottom cover 50 to form a smooth monolithic surface.

FIGS. 8 and 9 are two sectional views showing an assembled state of the night lamp 100 according to the present invention in different angles. When being assembled, the base ring 30 is first disposed in the first cavity 14 of the upper cover 10. In this case, as shown in FIG. 9, the ring body 32 of the base ring 30 enters into the first cavity 14 of the upper cover 10, and is in engagement with the locking groove 28 thereof. At the same time, the bottom portion 15 of the upper cover 10 is inserted into the recess 37 formed between the ring body 32 and the tongues 42 of the base ring 30. That is, on the one hand, the ring body 32 is in engagement with the locking groove 28 of the upper cover 10, and on the other hand, the bottom portion 15 of the upper cover 10 is in engagement with the recess 37 of the base ring 30, thereby providing an effective and firm positioning. In this way, the upper cover 10 and the base ring 30 are reliably assembled together.

After that, the sub-assembly formed by the upper cover 10 and the base ring 30 is mounted on the bottom cover 50. At this time, the cylinder 40 of the base ring 30 is inserted into the second cavity 54 of the bottom cover 50, and the first tooth 46 on the cylinder 40 of the base ring 30 are in engagement with the second tooth 60 on the connecting members 58 of the bottom cover 50, as shown in FIG. 8. In this case, the projections 22 of the upper cover 10 pass through the notches 44 in the tongues 42 of the base ring 30, respectively, to enter the recesses 65 of the bottom cover 50, while the annular vertical wall 62 of the bottom cover 50 enters into the annular groove 16 of the upper cover 10. Therefore, according to the present invention, the special structure of the connecting member 58 can simultaneously provide an engagement between the first tooth 46 and the second tooth 60 and that between the projections 22 and the recesses 65. These two engagements, together with that between the annular vertical wall 62 and the annular groove 16, can enable the entire device being securely assembled together.

In addition, each projection 22 has a circular bulge 25 protruding outward, which can be used as an undercut for preventing the sub-assembly formed by the upper cover 10 and the base ring 30 from being pulled out from the bottom cover 50. In manner, the stability of the assembly is improved.

As shown in FIG. 8, in the assembled state, the cylinder 40 of the base ring 30 is inserted into the second cavity 54 of the bottom cover 50. In this way, the support posts 55 of the bottom cover 50, the control unit 70, the battery 80, and the lamp bead 78 are all housed inside the cylinder 40 and the lamp cover 35. In this structure the space inside the device is effectively utilized, so that the device is very compact as a whole.

After being assembled, the base ring 30 is completely hidden inside the upper cover 10 and the bottom cover 50. The night lamp 100 thus formed presents a complete ellipsoid without any exposed parts. Therefore, the appearance of the night lamp 100 according to the present invention is beautiful, and convenient to carry.

It should be noted that although the shape of the night lamp 100 is described here with an ellipsoid as an example, it can be understood that the night lamp 100 can be formed into a sphere of any shape. More importantly, the term "sphere" in the context is desired to include an object with any shape, such as a pyramid, a cone, a cuboid or the like. Moreover, the upper cover 10 and the bottom cover 50 of the night lamp 100 according to the present invention can have different shapes, as long as they can be assembled together. For example, in an embodiment not shown, the upper cover 10 is a pyramid while the bottom cover 50 is a cuboid.

In the following, the method for controlling the night lamp 100 according to the present invention will be described.

In an initial state, by pressing the flexible upper cover 10 to bring the inner surface 12 thereof into contact with the conductive spring 75 that extends into the first cavity 14 of the upper cover 10, the control unit 70 (i.e., the PCB) will be in a power-on state, wherein the control unit 70 can control the lamp bead 78. The control unit 70 includes a state sensor. A specific example of a state sensor is shown in FIG. 1 in a very schematic manner, namely a flip switch 82. The flip switch 82 may be, for example, a commercially available double bead type flip switch, which may be integrated on the PCB. When the night lamp 100 is in a first state, wherein, for example, the bottom cover 50 faces downward, the flip switch 82 sends out a first instruction, so that the lamp bead 78 does not emit light. However, when the night lamp 100 is turned over into a second state, wherein, for example, the bottom cover 50 faces upward, the flip switch 82 sends out a second instruction, so that the lamp bead 78 starts to emit light.

In a preferred embodiment, the control unit 70 includes two flip switches 82, wherein a first flip switch is mounted on a front side of the control unit 70 (for example, a PCB), and a second flip switch is mounted on a back side thereof. In this case, the first flip switch is dedicated to detect the first state of the night lamp 100 (i.e., the bottom cover 50 faces downward), and the second flip switch is dedicated to detect the second state thereof (i.e., the bottom cover 50 faces downward). When the night lamp 100 is in the first state, the first flip switch sends out the first instruction to activate the lamp bead 78 to emit light; and when the night lamp 100 is in the second state, the second flip switch sends out the second instruction to activate the lamp bead 78 to emit light. In this way, the accuracy of the state sensor for state detection can be effectively improved, and false activation can be avoided.

In an embodiment not shown, the state sensor is a gyroscope.

By providing the state sensor in the night lamp 100, lighting can be easily provided through turning over the night lamp 100 by the user. In this case, there is no need for the user to extend out his arm to activate the mechanical switch, and no accidental activation generated by background noise occurs. Therefore, the operation of the night lamp 100 according to the present invention is simple.

On the other hand, the control unit of the present invention can be powered off by a certain action, which is, for example, three consecutive taps on the device. In response to the three taps, the control unit of the night lamp 100 is powered off. In this case, the lamp bead 78 will never emit light regardless of whether the device is turned over or not. In this state, the night lamp 100 can be conveniently carried without accidental light-emitting.

In addition, the control unit of the present invention is further configured to adjust brightness and color temperature of light by detecting the contact between the upper cover 10 and the lamp cover 25. When the upper cover 10 is pressed into contact with the lamp cover 25 for a long time, the control unit can change the brightness and the color temperature of the light emitted by the lamp bead 78 based on this contact state. For example, when the night lamp 100 is initially turned on, the lamp bead 78 can emit warm-toned light, which is more conducive to the user's newly opened eyes. After a period of time, the lamp bead 78 emits warm- or cold-toned light to provide better lighting conditions to the user. At the same time, the control unit can adjust the brightness of the light based on an inverse gamma curve. In a preferred embodiment, the brightness initially provided by the night lamp 100 according to the present invention after turn-on is extremely low, so the control unit can provide up to 2100 different brightness levels. By adjusting both of the brightness arid the color temperature of the light at the same time, the night lamp 100 according to the present invention can provide very delicate, almost stepless, adjustment. The relationship between the brightness and the color temperature of the light emitted by the lamp bead 78 and the contact time between the upper cover 10 and the lamp cover 25 can be selected according to actual needs.

According to the present invention, a control method for automatically turning off the night lamp 100 is also provided. For example, by tapping the night lamp 100 twice, the lamp bead 78 can automatically adjust the light from bright to dark, until it goes out. The specific time from when the lamp bead 78 is turned on to when it is turned off may also be set according to actual needs.

One skilled in the art can easily understand that the above control methods can be implemented with well-known control principles and techniques.

Finally, it should be noted that the above descriptions are merely preferred embodiments of the present invention, and do not restrict the present invention in any manner. Although the present invention has been described in detail with reference to the foregoing embodiments, those skilled in the art can still modify the technical solutions described in the foregoing embodiments or substitute equivalent technical features therein. Any modification, equivalent replacement, or improvement made within the spirit and principle of the present invention shall fall within the protection scope of the present invention.

The invention claimed is:

1. A night lamp (100), comprising:

a flexible partially spherical upper cover (10), which has a wall (13) defining a first cavity (14) and having a flat bottom portion (15);

a base ring (30), including a ring body (32), a lamp cap (35) arranged at a first side of the ring body (32), and a hollow cylinder (40) arranged at a second side thereof;

a partially spherical bottom cover (50), which defines a second cavity (54) and has a mating surface (64); and a light-emitting assembly (90) comprising a control unit (70), a lamp bead (78) mounted on the control unit (70), and a battery (80), wherein the control unit (70) includes a state sensor configured to activate the lamp bead (78) not to emit light when the bottom cover (50) faces downward but to emit light when the bottom cover (50) faces upward, wherein the base ring (30) is configured to be in engagement with the upper cover (10) and the bottom cover (50) at the same time, so that the bottom portion (15) of the upper cover (10) is abutted against the mating surface (64) of the cover (50), and the upper cover (10) and the bottom cover (50) together form a complete sphere, wherein the ring body (32) and the lamp cap (35) of the base ring (30) are located in the first cavity (14) while the hollow cylinder (40) is located in the second cavity (54), and the light-emitting assembly (90) is located in the hollow cylinder (40), wherein several support posts (58) are provided in the second cavity (54) of the bottom cover (50), the control unit (70) being mounted on the support posts (58) and the battery (80) being located in a space defined by the support posts (58), wherein the state sensor comprises two flip switches (82), which are respectively mounted on two opposite surfaces of the control unit (70), and wherein a first flip switch is configured to activate the lamp bead (78) not to emit light when the bottom cover (50) faces downward, while a second flip switch is configured to activate the lamp bead (78) to emit light when the bottom cover (50) faces upward.

2. The night lamp (100) according to claim 1, wherein the bottom portion (15) extends radially inward, thereby defining an annular locking groove (28) in the first cavity (14), the ring body (32) being in engagement with the locking groove (28).

3. The night lamp (100) according to claim 2, wherein an annular groove (16) is formed in the bottom portion (15) to divide the bottom portion (15) into an outer part (18) and an inner part (20), the latter being provided with a plurality of projections (22) spaced apart from each other.

4. The night lamp (100) according to claim 3, wherein each projection (22) extends downward beyond the bottom portion (15), and is provided with a circular bulge (25) extending radially inward at a root part thereof.

5. The night lamp (100) according to claim 4, wherein a plurality of tongues (42) protruding radially outward is provided on an outer periphery of the cylinder (40) of the base ring (30), forming an annular recess (37) between the tongues (42) and the base ring (30), and wherein a first tooth (46) is provided between two adjacent tongues (42), and each tongue (42) is provided with a notch (44) for allowing a corresponding projection (22) to pass therethrough.

6. The night lamp (100) according to claim 5, wherein the mating surface (64) of the bottom cover (50) has an annular vertical wall (62) extending outward, which is configured to extend into the annular groove (16) for engagement therewith.

7. The night lamp (100) according to claim 6, wherein a plurality of connecting members (58) is provided in the second cavity (54) of the bottom cover (50), each including an arc-shaped plate (59) and a plurality of ribs (57) connecting the arc-shaped plate (59) with the vertical wall (62), so that the ribs (57), the arc-shaped plate (59) and the vertical wall (62) together define a recess (65) for receiving a corresponding projection (22), and wherein a second tooth (60) is arranged on an inner side of each arc-shaped plate (59) for engagement with a corresponding first tooth (46).

8. The night lamp (100) according to claim 1, wherein the state sensor is a gyroscope.

9. The night lamp (100) according to claim 1, wherein the lamp cap (35) is spaced from an inner surface (12) of the upper cover (10), and the control unit (70) includes a conductive spring (75), which extends through the lamp cap (35) to enter the first cavity (14), and wherein the upper cover (10) can be pressed to contact the conductive spring (75), so that the control unit (70) is in a power-on state.

10. The night lamp (100) according to claim 1, wherein the lamp cap (35) contains light-homogenizing powders.

11. The night lamp (100) according to claim 1, wherein the bottom cover (50) has a central hole (92), in which a removable plug (95) is arranged.

12. A method for controlling a night lamp comprising:

a flexible partially spherical upper cover (10), which has a wall (13) defining a first cavity (14) and having a flat bottom portion (15);

a base ring (30), including a ring body (32), a lamp cap (35) arranged at a first side of the ring body (32), and a hollow cylinder (40) arranged at a second side thereof;

a partially spherical bottom cover (50), which defines a second cavity (54) and has a mating surface (64); and a light-emitting assembly (90), wherein the base ring (30) is configured to be in engagement with the upper cover (10) and the bottom cover (50) at the same time, so that the bottom (15) of the upper cover (10) is abutted against the mating surface (64) of the cover (50), and the upper cover (10) and the bottom cover (50) together form a complete sphere, and wherein the ring body (32) and the lamp cap (35) of the base ring (30) are located in the first cavity (14) while the hollow cylinder (40) is located in the second cavity (54), and the light-emitting assembly (90) is located in the hollow cylinder (40), the method comprising steps of:

pressing the upper cover to contact with a conductive spring, so that a control unit is in a power-on state;

placing the night lamp in a state in which the bottom cover faces downward, whereby a lamp bead does not emit light; and placing the night lamp in a state in which the bottom cover faces upward, whereby the lamp bead emits light.

13. The method according to claim 12, further comprising tapping the night lamp three times consecutively to activate the control unit in a power-off state.

14. The method according to claim 12, further comprising tapping the night lamp twice o enable the lamp bead to emit light from bright to dark for a period of time, until it goes out.

15. The method according to claim 12, further comprising pressing the upper cover to contact with the conductive spring for a period of time, so that the light emitted by the lamp bead has a brightness that gradually changes from dark to bright, and a color temperature that gradually changes from warm tone to cold tone during this period of time.

16. A night lamp (100), comprising: a flexible partially spherical upper cover (10), which has a wall (13) defining a first cavity (14) and having a flat bottom portion (15); a base ring (30), including a ring body (32), a lamp cap (35) arranged at a first side of the ring body (32), and a hollow cylinder (40) arranged at a second side thereof; a partially spherical bottom cover (50), which defines a second cavity (54) and has a mating surface (64); and a light-emitting assembly (90), wherein the base ring (30) is configured to be in engagement with the upper cover (10) and the bottom cover (50) at the same time, so that the bottom portion (15) of the upper cover (10) is abutted against the mating surface (64) of the cover (50), and the upper cover (10) and the bottom cover (50) together form a complete sphere, wherein the ring body (32) and the lamp cap (35) of the base ring (30) are located in the first cavity (14) while the hollow cylinder (40) is located in the second cavity (54), and the light-emitting assembly (90) is located in the hollow cylinder (40), wherein the bottom portion (15) extends radially inward, thereby defining an annular locking groove (28) in the first cavity (14), the ring body (32) being in engagement with the locking groove (28), and wherein an annular groove (16) is formed in the bottom portion (15) to divide the bottom portion (15) into an outer part (18) and an inner part (20), the latter being provided with a plurality of projections (22) spaced apart from each other.

17. The night lamp (100) according to claim 16, wherein each projection (22) extends downward beyond the bottom portion (15), and is provided with a circular bulge (25) extending radially inward at a root part thereof.

18. The night lamp (100) according to claim 17, wherein a plurality of tongues (42) protruding radially outward is provided on an outer periphery of the cylinder (40) of the base ring (30), forming an annular recess (37) between the tongues (42) and the base ring (30), and wherein a first tooth (46) is provided between two adjacent tongues (42), and each tongue (42) is provided with a notch (44) for allowing a corresponding projection (22) to pass therethrough.

19. The night lamp (100) according to claim 18, wherein the mating surface (64) of the bottom cover (50) has an annular vertical wall (62) extending outward, which is configured to extend into the annular groove (16) for engagement therewith.

* * * * *